US006427456B2

(12) United States Patent
Niwa et al.

(10) Patent No.: US 6,427,456 B2
(45) Date of Patent: Aug. 6, 2002

(54) AUTOMATIC ICE MAKER

(75) Inventors: Yasushi Niwa; Kentaro Yamane; Eiji Kuroda; Kazufumi Yamashita; Hitoshi Ando; Atsuo Nakayama; Naoko Toida, all of Gunma (JP)

(73) Assignee: Japan Servo Co. Ltd., Tokyo (JP)

( * ) Notice: Subject to any disclaimer, the term of this patent is extended or adjusted under 35 U.S.C. 154(b) by 0 days.

(21) Appl. No.: 09/819,345

(22) Filed: Mar. 28, 2001

(30) Foreign Application Priority Data

Mar. 28, 2000 (JP) ..... 2000-088250

(51) Int. Cl.[7] ..... F25C 1/12
(52) U.S. Cl. ..... 62/137
(58) Field of Search ..... 62/137, 353

(56) References Cited

U.S. PATENT DOCUMENTS 2,799,144 A * 7/1957 Barton ..... 62/353
2,982,111 A * 5/1961 Dahl ..... 62/137
5,010,738 A 4/1991 Brown et al. ..... 62/135
5,119,639 A * 6/1992 Bein et al. ..... 62/137
5,400,605 A * 3/1995 Jeong ..... 62/353
5,619,858 A * 4/1997 Gunderson et al. ..... 62/137
6,050,097 A * 4/2000 Nelson et al. ..... 62/137

* cited by examiner

*Primary Examiner*—William E. Tapolcai
(74) *Attorney, Agent, or Firm*—Nilles & Nilles SC

(57) ABSTRACT

An automatic ice maker for use in freezing compartments of the refrigerators. A planar stop arm is used as an ice cube detecting device for detecting a sufficient ice cubes stored in a bin arranged below a tray for making ice cubes. The stop arm can be swung between the bin for storing therein the ice cubes and the tray in order prevent the ice cubes stored in the bin from being molten by a head radiation from a heater provided on the tray.

6 Claims, 13 Drawing Sheets

AUTOMATIC ICE MAKER

BACKGROUND OF THE INVENTION

1. Field of the Invention

This invention relates to an automatic ice maker and, more particularly, relates to an automatic ice maker for household refrigerators.

2. Description of the Prior Art

FIG. 16 and FIG. 17 show a conventional automatic ice maker disclosed in the U.S. Pat. No. 5,010,738, wherein a reference numeral 1 denotes a tray for making ice cubes, 2 denotes an array of stationary fingers mounted on one side of an upper surface of the tray 1, 3 denotes a rotary shaft extending along the center line of the upper surface of the tray 1 and to be rotated by a motor (not shown), 4 denotes an array of ejector fingers fixed to the rotary shaft 3 for rotation therewith so as to interleave with the stationary fingers 2 and cooperate therewith to cause the ice cubes to be deposited in a bin 8 arranged below the tray 1. A reference numeral 5 denotes a control box, 6 denotes a water supply box, 7 denotes an ice cube detecting device for detecting whether a sufficient ice cubes are located within the bin 8 or not, and 9 denotes a freezer compartment of a refrigerator 10.

In the tray 1, a thermostat and a heater are installed. The heater and the motor are energized when the water is frozen in the tray 1 and the thermostat is turned ON, so that a surface of the ice cubes attached to the tray 1 are molten and that the ice cubes in the tray 1 is ejected to the bin 8 by the ejector fingers 4 when the motor is rotated. The water supply to the tray 1 is started and a quantity of water determined according to the angular position of the motor is supplied to the tray 1 to make ice cubes, again. The above cycle is repeated.

When the ice cube detecting device 7 detects a sufficient quantity of ice cubes located within the bin 8, the automatic operation of the ice maker is stopped temporarily. The automatic operation of the ice maker is restarted when the quantity of the ice cubes located within the bin 8 is reduced. The ice cube detecting device 7 comprises a stop arm in the form of a wire and swings along an arc above the bin 8 to detect the upper surface of the ice cubes located within the bin 8. However, the above-mentioned conventional automatic ice maker has many problems and defects. The stop arm is sometimes broken when it is brought into contact with the ice cubes. The ice cubes stored in the bin 8 positioned below the bottom surface of the tray 1 are liable to melt by a heat radiation from the tray 1, when the heater is energized.

SUMMARY OF THE INVENTION

An object of the present invention is to solve the above problems.

Another object of the present invention is to provide an automatic ice maker for use in household refrigerators comprising a water supply device, a tray for making ice cubes, an ice cube ejector device, a heater for separating ice cubes from the tray, a sensor for sensing a temperature of the tray, a bin for storing therein ice cubes, an ice cube detecting device for detecting ice cubes located within the bin, and an electronic control circuit for controlling the ice making operation, wherein said components other than the water supply device are arranged in a freezer compartment of the refrigerator, and the ice cube detecting device is formed of a planar stop arm movable to a position between the tray and the bin according to the energization and deenergization of the heater.

Said stop arm has an upper surface inclined downwards gradually from a tray side to an opposite side.

Said stop arm is supported through a spring and rotated by a drive shaft.

Said stop arm can be moved horizontally. Said electronic control circuit comprises an original point hole IC and a magnet faced to each other with a gap therebetween, and said magnet is composed of N and S poles superposed to each other.

These and other objects and features of the present invention will become apparent from the following description in conjunction with the attached drawings.

DESCRIPTION OF THE PREFERRED EMBODIMENTS

As automatic ice maker according to the present invention will now be explained with reference to the attached drawings.

Figure 1:
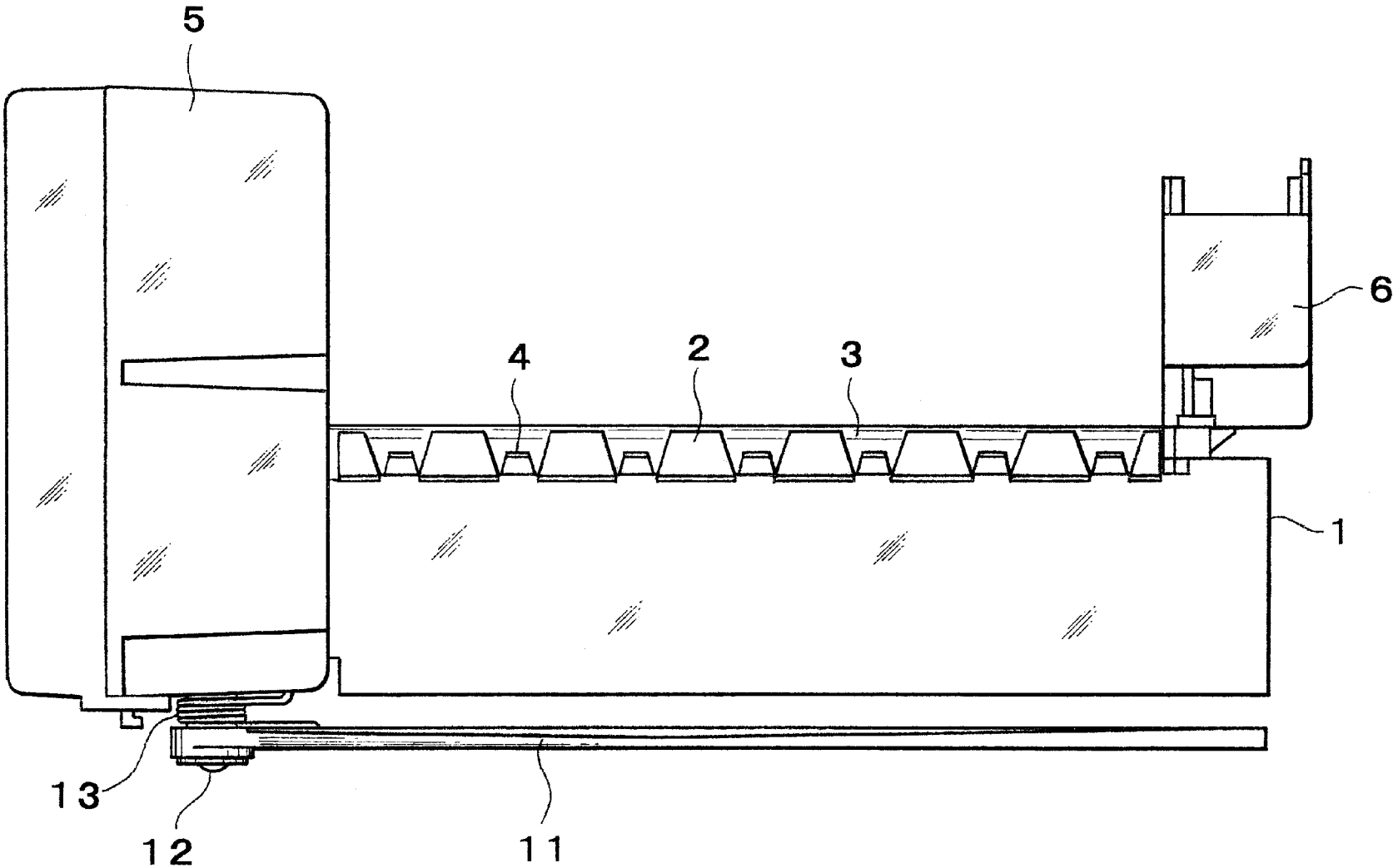
FIG. 1 is a front view of an automatic ice maker according to the present invention.
Figure 2:
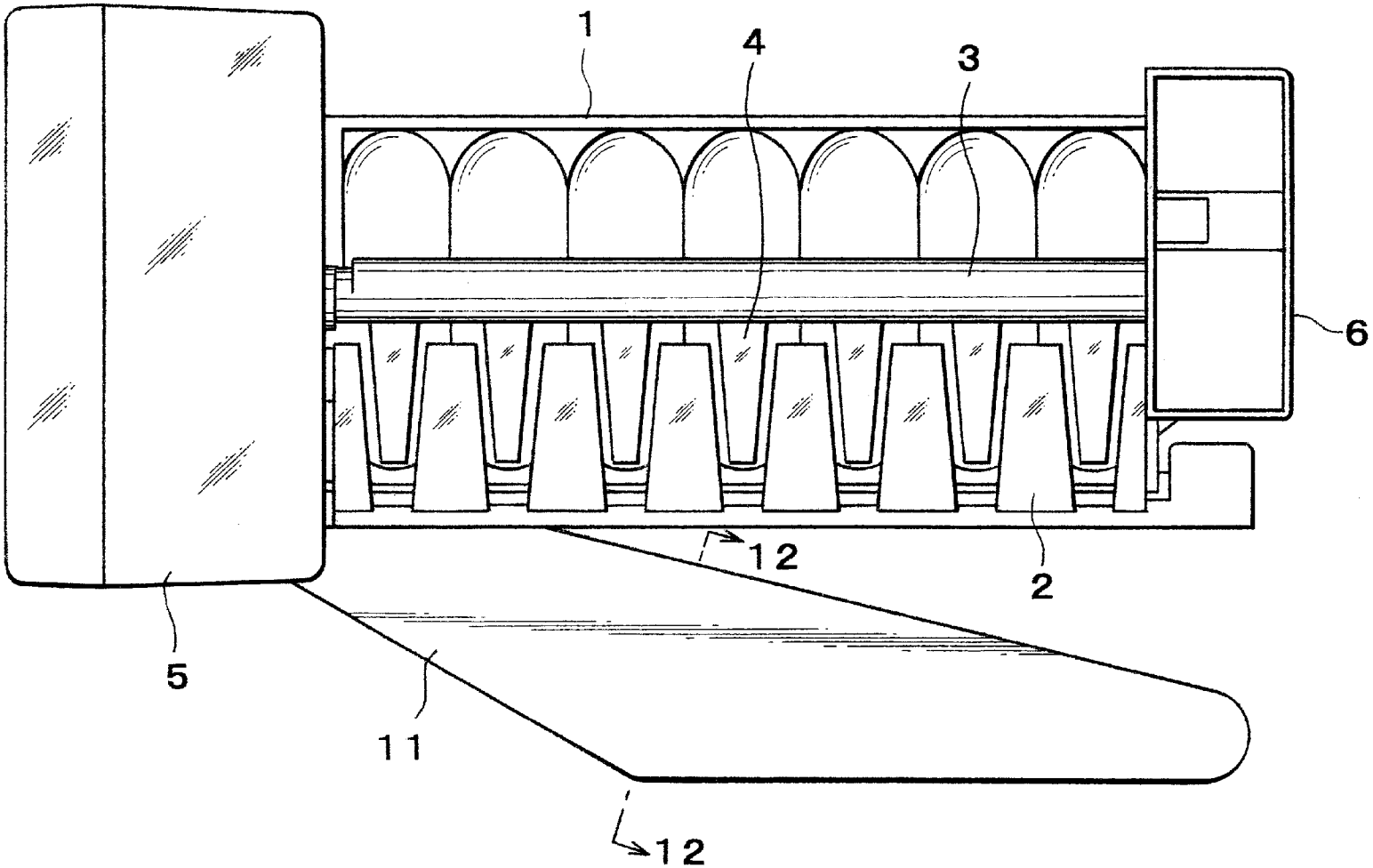
FIG. 2 is a plan view of an automatic ice maker according to the present invention.
Figure 3:
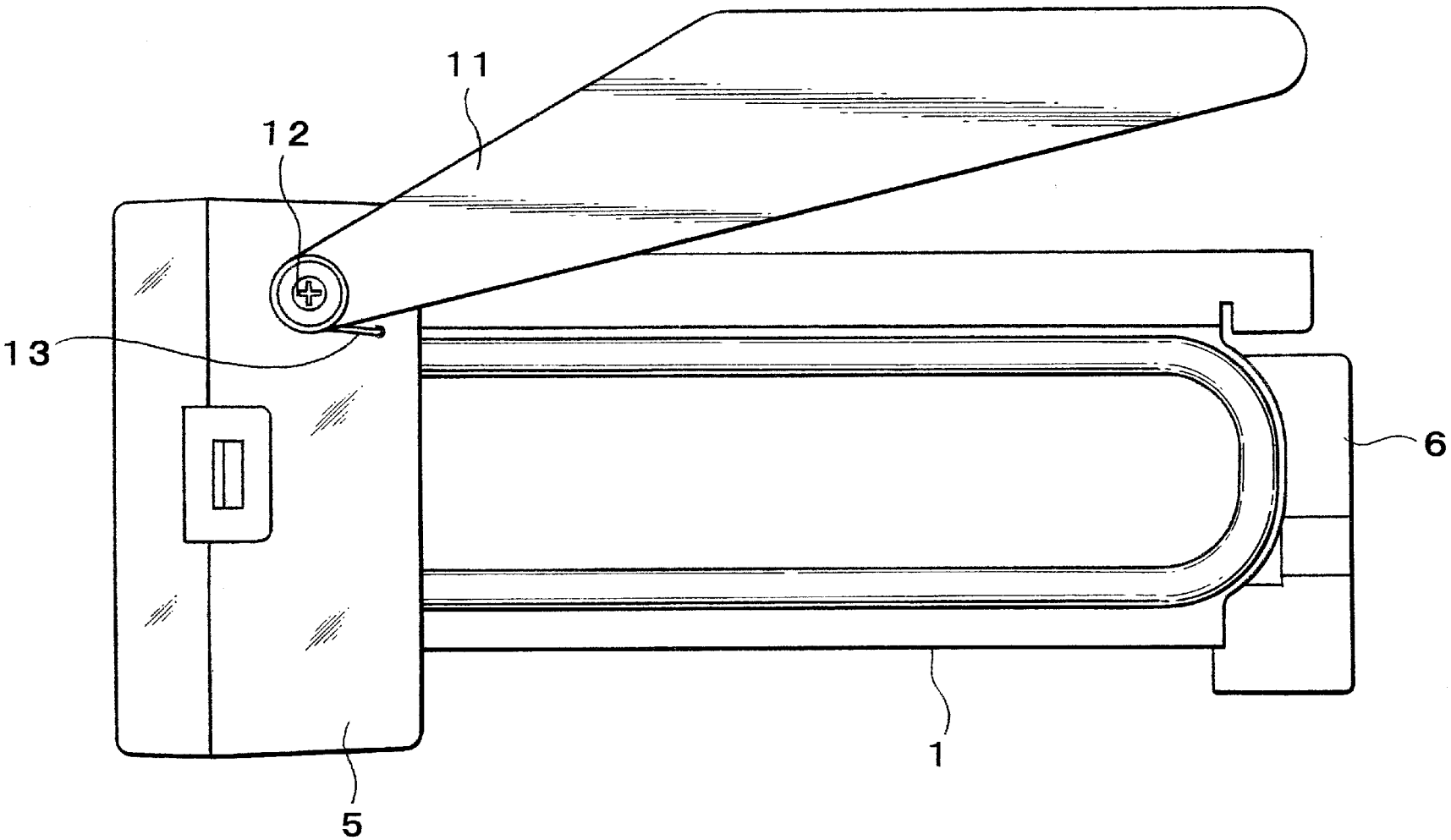
FIG. 3 is a bottom view of an automatic ice maker according to the present invention.
Figure 4:
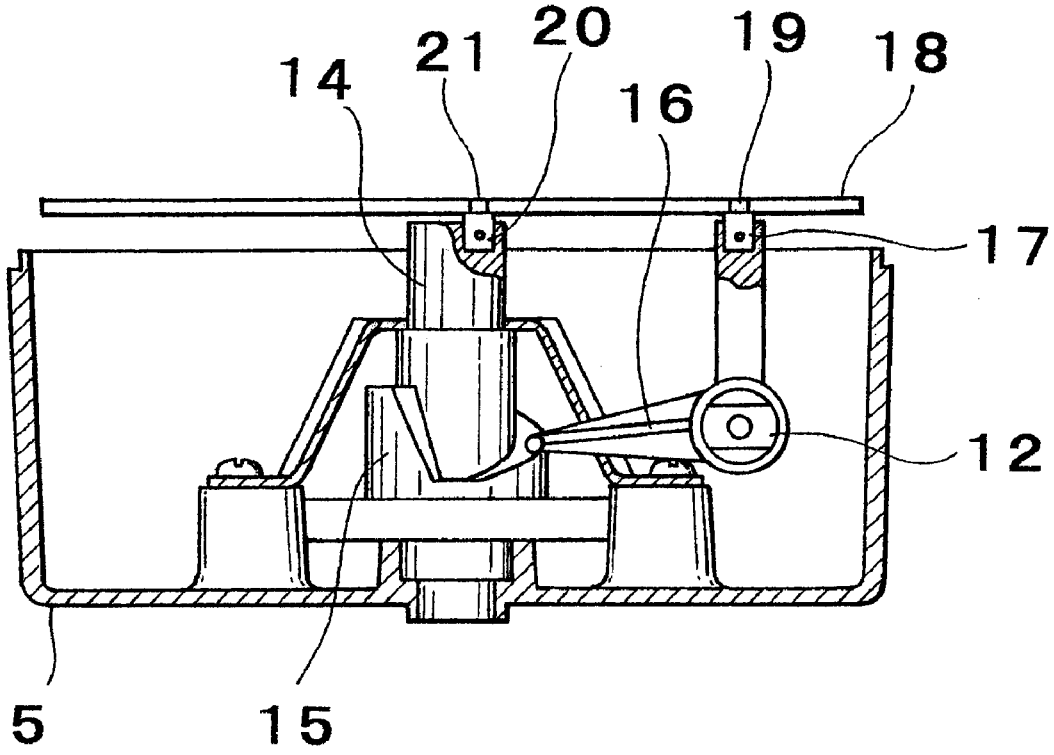
FIG. 4 is a schematic view of a stop arm drive portion of an automatic ice maker according to the present invention.
Figure 5:
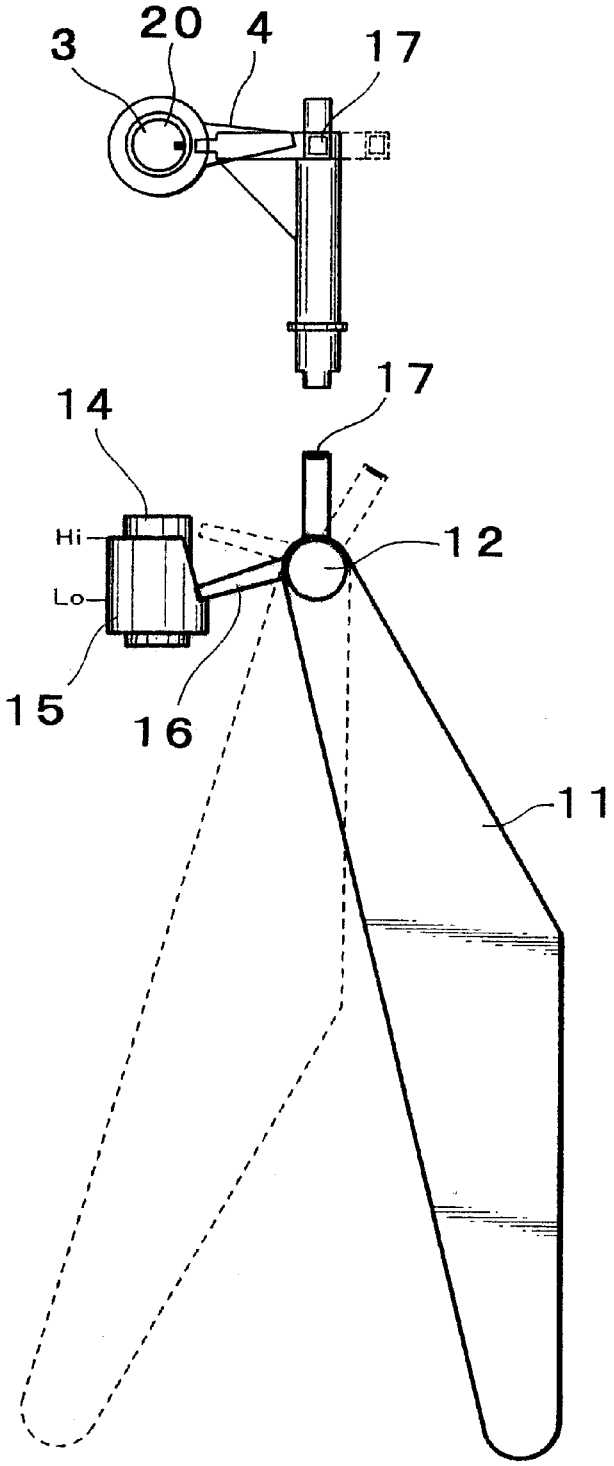
FIG. 5 is a schematic view of a stop arm operation of an automatic ice maker according to the present invention.

According to the present invention, an elongated stop arm 11 in the form of a triangular plate is used as shown in FIG. 1 to FIG. 3 instead of using the stop arm in the form of a wire as in the conventional automatic ice maker. The distal end of the stop arm 11 is supported through a coil spring 13 rotatably by a driving shaft 12 projected from the bottom surface of a control box 5 so that the stop arm 11 can be rotated with respect to the driving shaft 12 against the force of the coil spring 13 when the stop arm 11 is hit against an obstacle. As shown in FIG. 4 and FIG. 5, a rod shaped cam follower 16 is provided on the driving shaft 12 so as to extend radially therefrom so that the tip end of the cam follower 16 is brought into contact with a cam surface of a cam 15 fixed to an output shaft 14 to be rotated by a motor. The configuration of the cam surface of the cam 15 is so determined that the stop arm 11 is positioned below the tray 1 when the heater is energized and that the stop arm 11 swings horizontally on the bin 8 according to the rotation of the ejector fingers 4 when the heater is not energized.

A magnet 17 is mounted on the tip end of an arm extending radially from the driving shaft 12, and an arm hole IC 19 is provided on a base plate 18 of the control box 5 facing the magnet 17 with a gap therebetween.

A magnet 20 is mounted on an end surface of the output shaft 14, and an original point hole IC 21 is provided on the base plate 18 facing the magnet 20 with a gap therebetween.

According to the automatic ice maker of the present invention, the stop arm 11 is positioned below the tray 1 directly before or directly after the energization of the heater, or at the same time of the energization of the heater, after the water in the tray 1 has been frozen, so that the ice cubes in the bin 8 is prevented from being molten by the heat radiation from the heater.

FIG. 5 shows a state that the stop arm 11 is positioned above the bin 8 and outside of the tray 1, the arm hole IC 19 is turned OFF, the original point hole IC 21 is turned ON, the water in the tray 1 is frozen, the thermostat is turned ON, and the heater is energized, but the ejector fingers 4 are not yet rotated.

Figure 6:
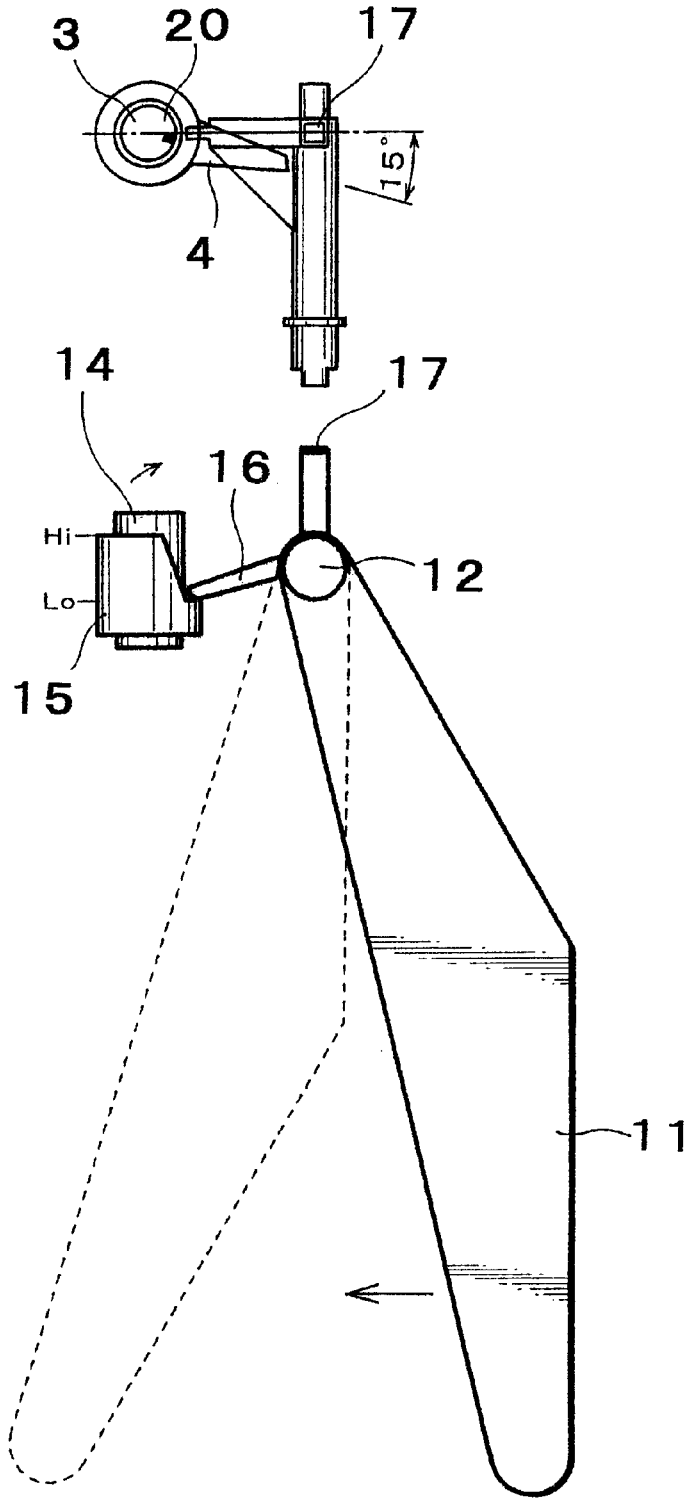
FIG. 6 is a schematic view of a stop arm operation of an automatic ice maker according to the present invention.

FIG. 6 shows a state after about 90 seconds from the energization of the heater. The stop arm 11 is not yet moved to the below the tray 1. The arm hole IC 19 and the original point hole IC 21 are turned OFF, and the ejector fingers 4 are rotated by 15°.

Figure 7:
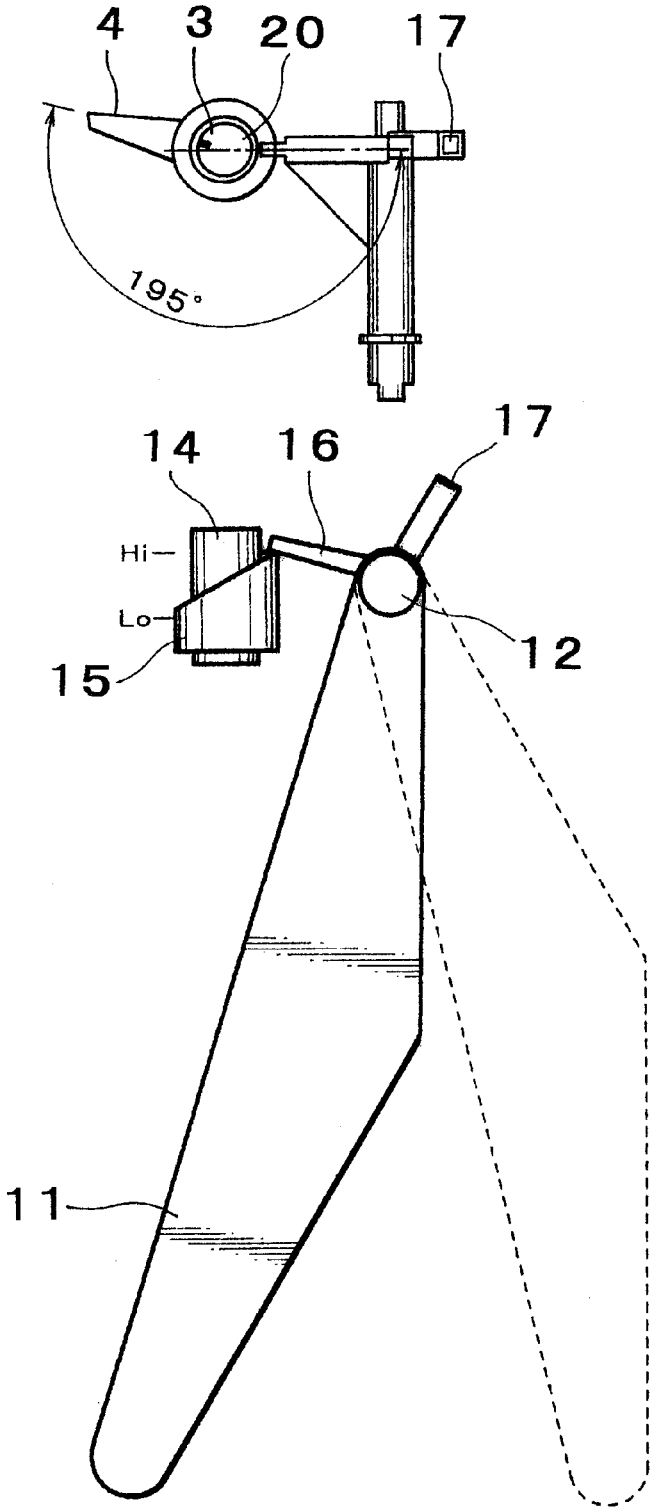
FIG. 7 is a schematic view of a stop arm operation of an automatic ice maker according to the present invention.

FIG. 7 shows a state that the stop arm 11 is swing and positioned below the tray 1, the ejector fingers 4 are rotated by 195°, the arm hole IC 19 is turned ON, and the original point hole IC 21 is turned OFF.

In this state, the ice cubes stored in the bin 8 are prevented from being molten by the heat radiation from the heater, because the stop arm 11 is positioned below the tray 1.

Figure 8:
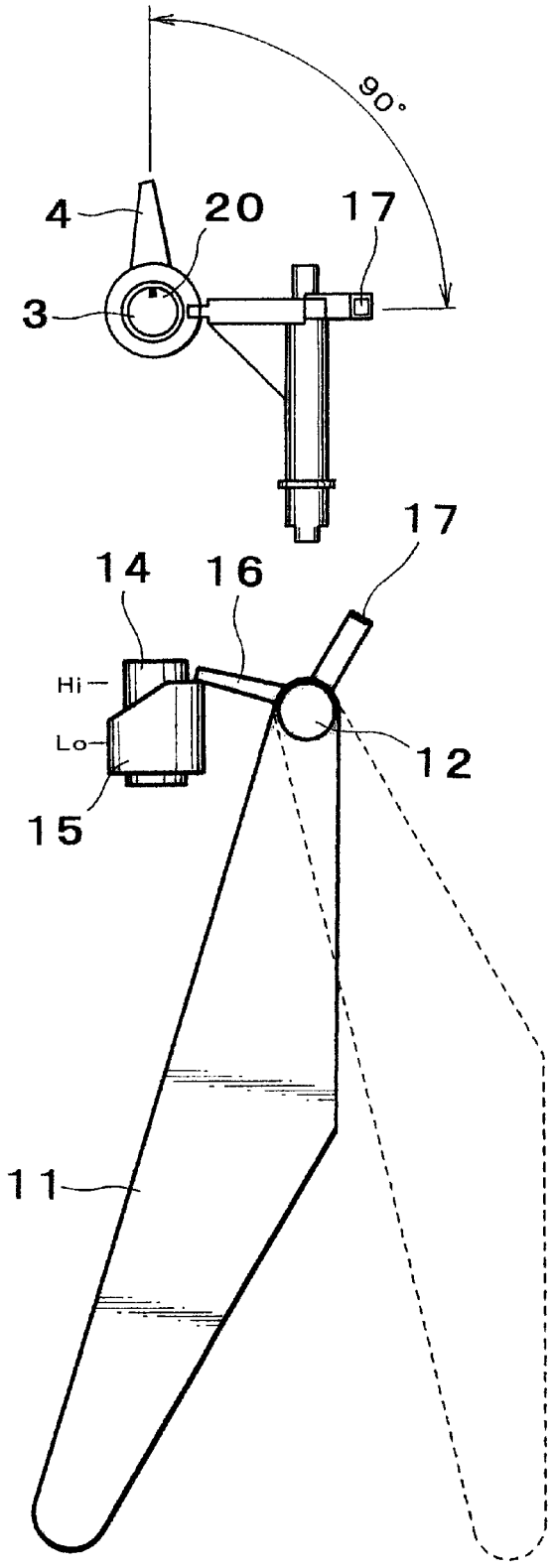
FIG. 8 is a schematic view of a stop arm operation of an automatic ice maker according to the present invention.

FIG. 8 shows a state that the stop arm 11 is not yet moved from below the tray 1 to the outside, but the ejector fingers 4 are rotated by 270°, the arm hole IC 19 is turned ON, and the original point hole IC 21 is turned OFF.

Figure 9:
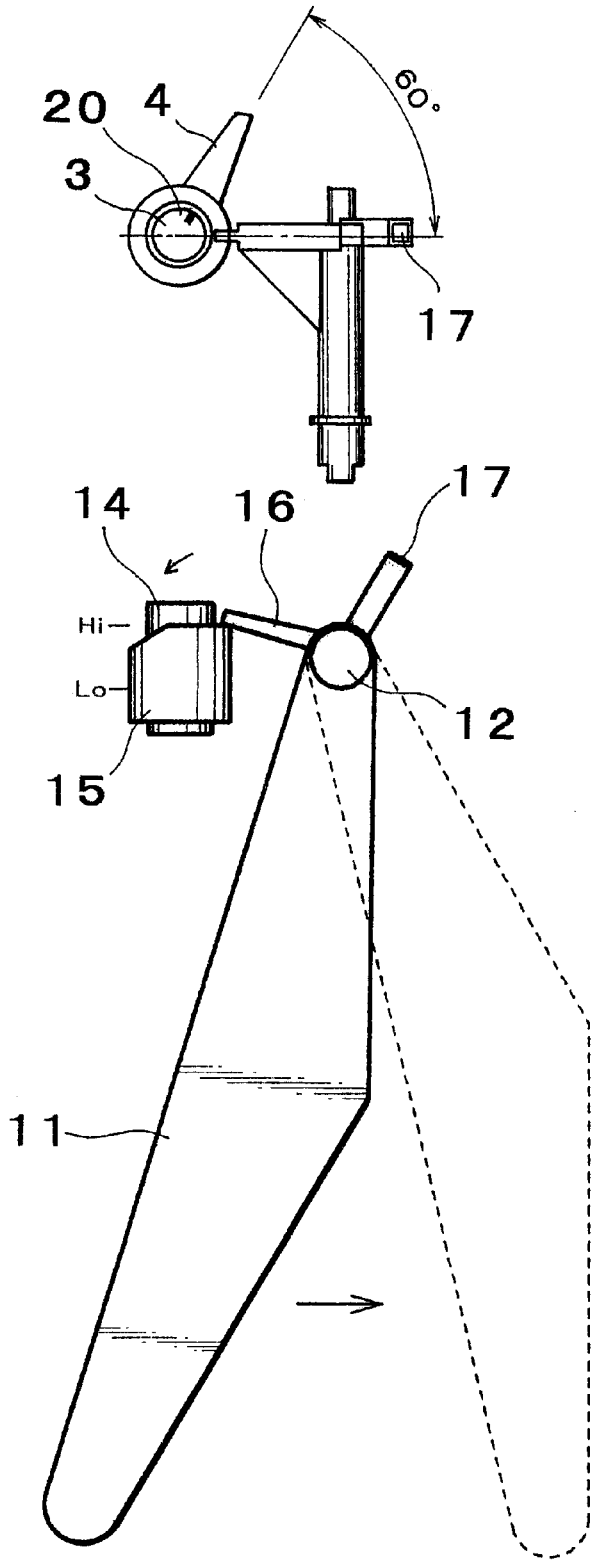
FIG. 9 is a schematic view of a stop arm operation of an automatic ice maker according to the present invention.

FIG. 9 shows a state that the stop arm 11 is not yet moved from below the tray 1 to the outside, but the ejector fingers 4 are rotated by 300°, the arm hole IC 19 is turned ON, and the original point hole IC 21 is turned OFF.

Figure 10:
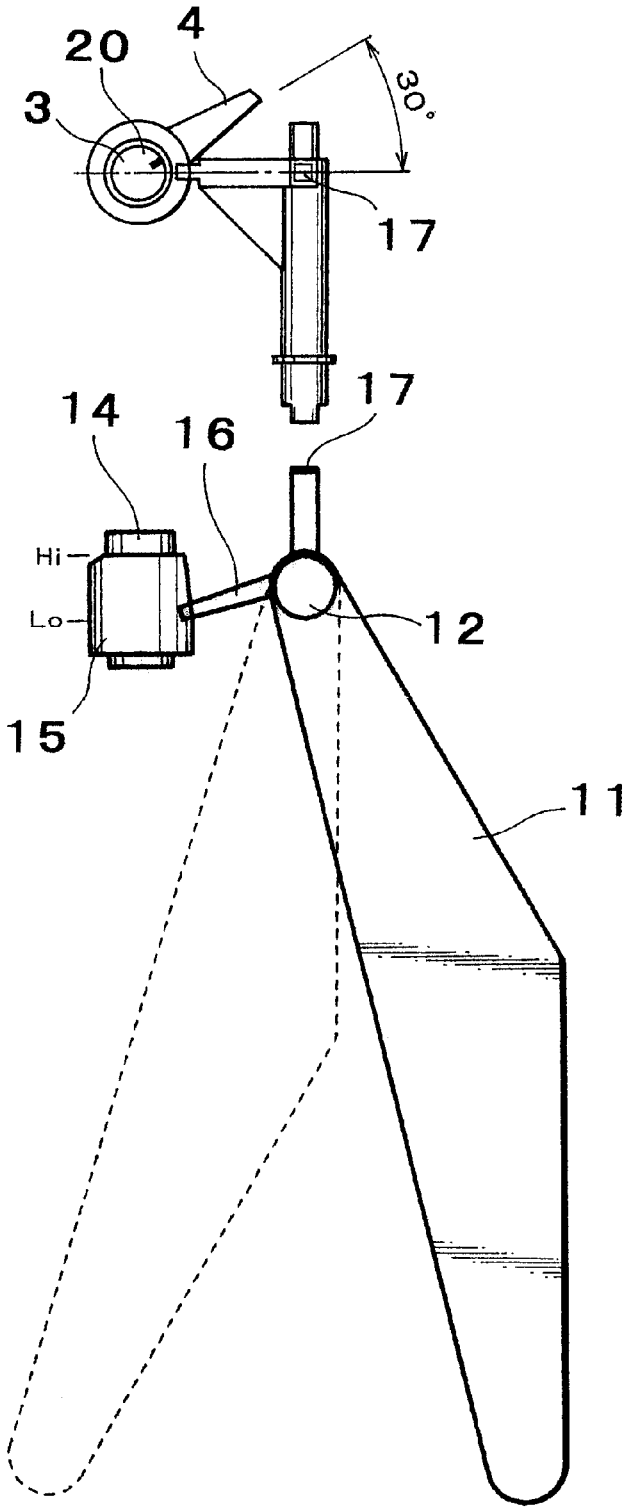
FIG. 10 is a schematic view of a stop arm operation of an automatic ice maker according to the present invention.

FIG. 10 shows a state that the stop arm 11 is swung and moved from below the tray 1 to the outside, the ejector fingers 4 are rotated by 330°, and the arm hole IC 19 and the original point hole IC 21 are turned OFF.

Figure 11:
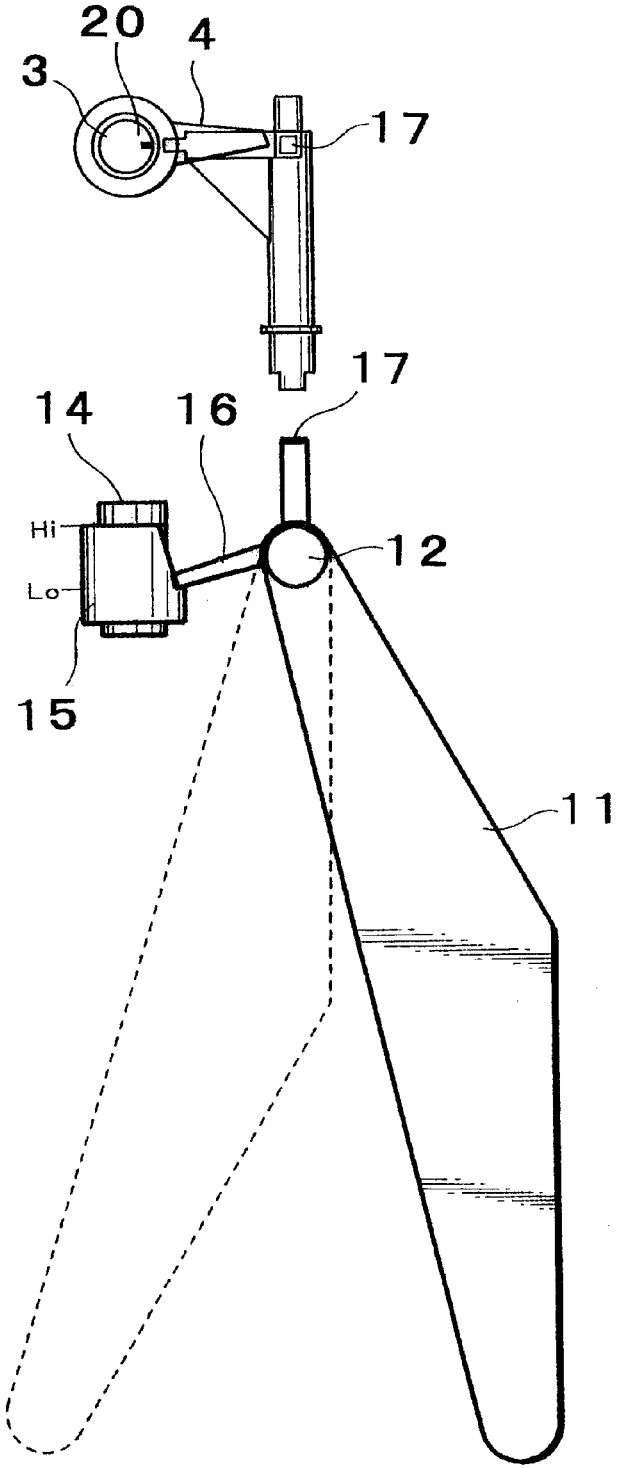
FIG. 11 is a schematic view of a stop arm operation of an automatic ice maker according to the present invention.

FIG. 11 shows a state that the stop arm 11 is positioned at the outside of the tray 1, the ejector fingers 4 are returned to the original position, the arm hole IC 19 is turned OFF, and the original point hole IC 21 is turned ON.

Figure 12:
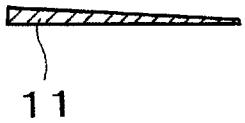
FIG. 12 is a cross section taken along line 12—12 of FIG. 2.

FIG. 12 shows a cross section of the stop arm 11. The upper surface of the stop arm 11 is inclined downwards gradually from the side of the tray 1 to the opposite side, so that the ice tips or water drops formed by the ejecting operation of the ejector fingers 4 are removed automatically when they are fallen on the stop arm 11.

Figure 13:
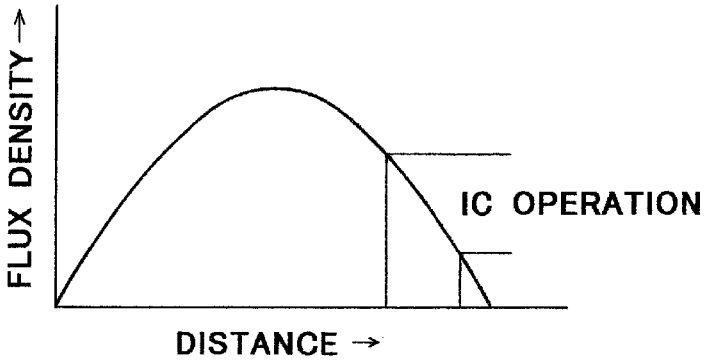
FIG. 13 is a schematic view of a magnet for an original point hole IC of an automatic ice maker according to the present invention.

Further, conventionally, either one of N and S poles of the conventional single magnet is used as the magnet 17 or 20 for the hole IC. In this case, however, the relation between the relative distance and the magnetic flux density of the original point hole IC 21 and the magnet 20 is shown by a gentle curve as shown in FIG. 13. The original point hole IC 21 is operated only when the distance between the original point hole IC 21 and the magnet 20 is changed to the large extent and the change of the magnetic flux density becomes a predetermined value, so that the precision of the operation of the original point hole IC 21 is deteriorated.

Figure 14:
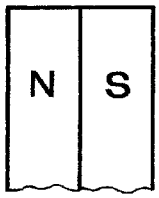
FIG. 14 is a schematic view of a magnet for an original point hole IC of an automatic ice maker according to the present invention.
Figure 15:
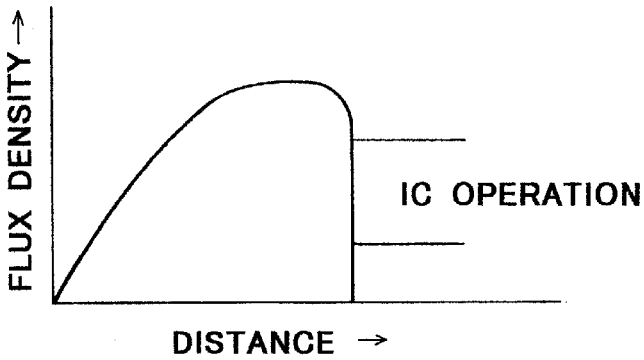
FIG. 15 is a schematic view of a magnet for an original point hole IC of an automatic ice maker according to the present invention.
Figure 16:
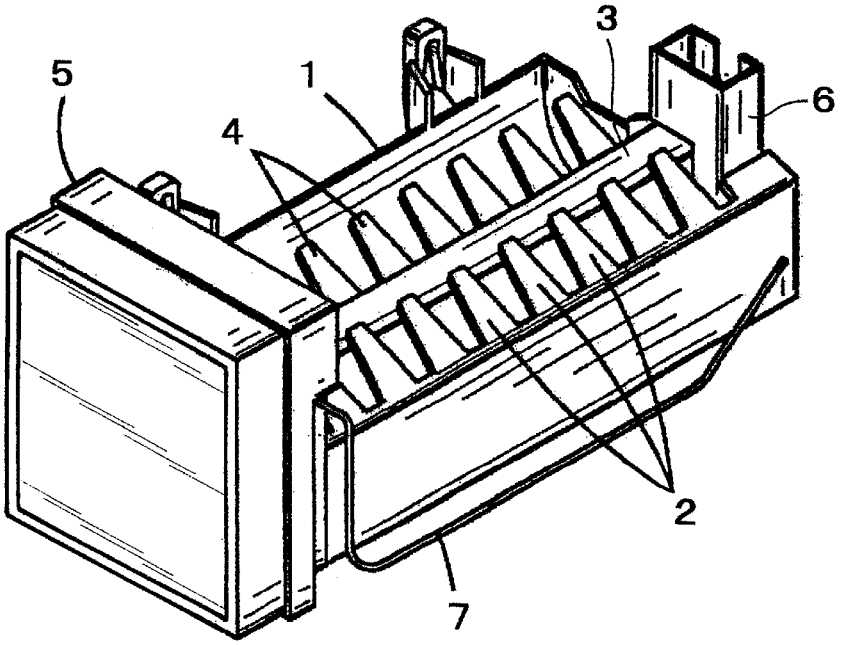
FIG. 16 PRIOR ART
FIG. 16 is an enlarged, perspective view illustrating a conventional automatic ice maker.
Figure 17:
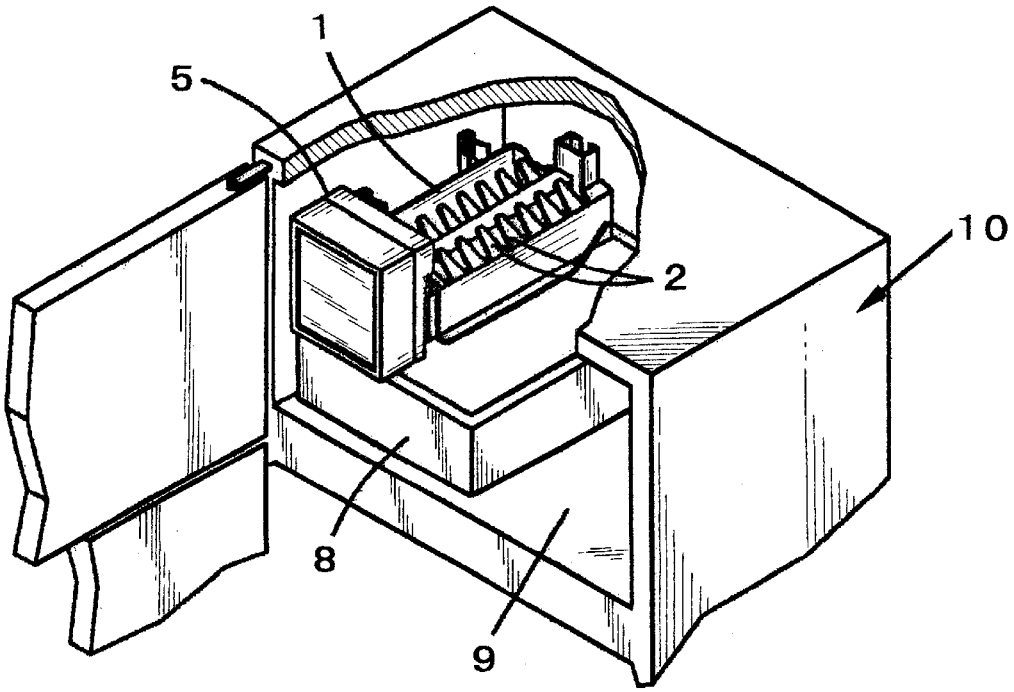
FIG. 17 PRIOR ART
FIG. 17 is a fragmentary, perspective view of a conventional automatic ice maker.

Accordingly, in the present invention, a magnet consisting of superposed N and S poles as shown in FIG. 14 is used as the magnet 20. In this case, the relation between the relative distance and the magnetic flux density of the original point hole IC 21 and the magnet 20 is shown by a curve having a sharply inclined portion as shown in FIG. 15. Accordingly, the original point hole IC 21 can be operated by a small change in distance if the above sharply inclined portion of the curve is used, so that the precision of the operation of the original point hole IC 21 can be enhanced.

As stated above, according to the present invention, the original point of rotation of the ejector fingers 4 can be detected by the original point hole IC 21, and the stop arm 11 can be swung according to the output of the arm hole IC 19 only when the output shaft 14 is in the angular position between 15° to 330°.

Further, the stop arm 11 can be prevented from being damaged. The ice cubes can be prevented from being molten by the heat radiation from the heater, because the stop arm 11 can be positioned below the bottom surface of the tray 1.

Furthermore, the operations of the ejector fingers 4 and the stop arm 11 can be controlled precisely by elevating the sensitivity of the original point hole IC 21.

It should be understood that many changes and modifications may be made within the scope of the present invention without departing from the spirit thereof. The scope of these changes will become apparent from the attached claims.

What is claimed is:

1. An automatic ice maker for use in household refrigerators comprising a water supply device, a tray for making ice cubes, an ice cube ejector device, a heater for separating ice cubes from the tray, a sensor for sensing a temperature of the tray, a bin for storing therein ice cubes, an ice cube detecting device for detecting ice cubes located within the bin, and an electronic control circuit for controlling the ice making operation, said electronic control circuit comprises an original point hole IC and a magnet faced to each other with a gap therebetween, and said magnet is composed of N and S poles superposed to each other, wherein said components other than the water supply device are arranged in a freezer compartment of the refrigerator, and the ice cube detecting device is formed of a planar stop arm movable to a position between the tray and the bin according to the energization and deenergization of the heater.

2. An automatic ice maker as set forth in claim 1, wherein said stop arm has an upper surface inclined downwards gradually from a tray side to an opposite side.

3. An automatic ice maker as set forth in claim 1, wherein said stop arm is supported rotatably through a spring by a drive shaft.

4. An automatic ice maker as set forth in claim 1, wherein said stop arm can be moved horizontally.

5. An automatic ice maker as set forth in claim 2, wherein said stop arm is supported rotatably through a spring by a drive shaft.

6. An automatic ice maker as set forth in claim 2, wherein said stop arm can be moved horizontally.

* * * * *